United States Patent [19]

Lackenbach

[11] Patent Number: 4,488,329

[45] Date of Patent: Dec. 18, 1984

[54] POWER SPRAY NOZZLE WITH FLUIDIC OSCILLATOR

[75] Inventor: Elliot A. Lackenbach, Somerset, N.J.

[73] Assignee: The Singer Company, Stamford, Conn.

[21] Appl. No.: 407,022

[22] Filed: Aug. 11, 1982

[51] Int. Cl.[3] ..... A47L 5/00

[52] U.S. Cl. ..... 15/322; 239/590

[58] Field of Search ..... 15/321, 322, 307, 320, 15/353, 404, 418 R, 418, 257.0 S, 381; 137/809, 811, 822, 842; 239/590, 289

[56] References Cited

U.S. PATENT DOCUMENTS

| | | | |
|---|---|---|---|
| 3,200,433 | 8/1965 | Downey | 15/321 X |
| 3,663,984 | 5/1972 | Anthony et al. | 15/321 X |
| 3,843,989 | 10/1972 | De Maagd | 15/320 X |
| 4,096,601 | 6/1978 | Knestele | 15/320 |
| 4,184,636 | 1/1980 | Bauer | 137/809 |
| 4,234,995 | 11/1980 | Parise | 15/322 |
| 4,260,106 | 7/1981 | Bauer | 239/590 |

*Primary Examiner*—Philip R. Coe
*Assistant Examiner*—Frankie L. Stinson
*Attorney, Agent, or Firm*—Edward P. Schmidt; Robert E. Smith; Edward L. Bell

[57] ABSTRACT

A power spray nozzle using a single fluidic oscillator to disseminate liquid, selectively and cyclically, from one end of a floor brush to the other and return.

3 Claims, 4 Drawing Figures

POWER SPRAY NOZZLE WITH FLUIDIC OSCILLATOR

BACKGROUND OF THE INVENTION

This invention is in the field of devices for cleaning fibrous floor coverings, such as carpets and the like; more particularly, it is concerned with a means in such a device for disseminating a liquid cleaning solution.

Today, cleaning of a carpet in place is a common necessity because of the overwhelming preponderance of wall-to-wall carpeting in homes and commercial buildings. A prior art device to accomplish this in place cleaning commonly includes an apparatus which sprays or otherwise discharges liquid onto the carpet to be cleaned, thoroughly brushes the liquid in and about the carpet fibers and recovers the dirt laden solution by a suitable vacuum or suction means immediately adjacent the carpet to pick up the spent liquid and transfer the same to a waste tank.

The prior art device heretofore known, such as disclosed in U.S. Pat. No. 3,883,301, issued May 13, 1975 to Emrick et al, has utilized a plurality of spray nozzles arranged in a manner calculated to assure a wide and even coverage of the area treated by the cleaning device. However, in spite of careful design, the coverage provided by multiple nozzles is not even, there being a heavier concentration of the liquid in any area of spray overlap. Also, with multiple nozzles, the flow-rate for each nozzle is smaller, increasing the potential for clogging of the fine bores required for the lower flow-rates. Still further, if the pump performance varies due to voltage variation or other causes, the spray angle on these nozzles may also be adversely affected and, consequently, the performance of the device is affected.

What is required is a device which does not have the above noted problems, and which is economical.

SUMMARY OF THE INVENTION

The above requirements are obtained in a carpet power spray in which the liquid dissemination is achieved by means of a single fluidic oscillator arranged to dispense a stream of liquid back and forth along the length of a floor brush supported in the power spray nozzle. The power spray nozzle includes a lower housing supporting a motor and floor brush connected thereto by a belt for brushing the liquid into the carpet. Also supported on a lower housing is the fluidic oscillator, arranged substantially centrally thereof so as to be able to direct its stream to either side along the length of the floor brush. An upper housing covers the lower housing and forms therewith a plenum chamber for liquid return orifices formed as part of the lower housing on a surface immediately adjacent the carpet. The plenum chamber between the upper and lower housings may lead to a swivel connector to a return wand connecting the carpet power spray to a source of vacuum in a carpet cleaning machine. Provision is made for a tubing connection to the fluidic oscillator for passage of the liquid from the carpet cleaning machine. In operation, a liquid release trigger is supplied which is depressed to release the liquid as the power spray device is pulled toward an operator. The liquid trigger is then released to halt dissemination of the liquid and the carpet power spray device is pulled back and forth over the carpet to allow the floor brush to work the liquid into the carpet fibers and to permit the liquid return orifices to take in the used or spent liquid and the return the same under the influence of the vacuum source, to a waste tank.

BRIEF DESCRIPTION OF THE DRAWINGS

Some of the objects of the invention having been stated, other objects will appear as the description proceeds, when taken in connection with the accompanying drawings, in which:

Referring to FIG. 1 there is shown a carpet power spray attachment device 10 which is connected to the vacuum source of a carpet cleaning machine (not shown) in the usual manner by a wand 10 to obtain suction therein, and to a source of liquid pressurized by means of a pump (not shown) in the carpet cleaning machine, through a tubing 14. The liquid used may selectively be water, a mix of water and a detergent, or any other solution suitable for the intended cleaning purpose and not harmful to the materials used in the attachment device 10. The wand 12 is connectable to the carpet power spray attachment device 10 by means of a swivel 16 which permits motion of the wand 12 with respect to the outer housing 18 of the attachment device without affecting passage of spent liquid from the attachment device to the carpet cleaning machine, in a manner well known in the prior art.

Referring now to FIG. 2, there is shown a cross-section of the power spray attachment device 10 shown in FIG. 1. As can be seen, the swivel 16 is captured between the outer housing 18 and an inner housing 20 so as to be turnable with respect thereto while providing for an air flow therethrough from a plenum chamber 21 formed between the outer housing and inner housing. The flow through the swivel 16 is taken in at the side thereof and turned at right angles to be presented to the wand 12 (see FIG. 3). A lens 19 is provided on the outer housing 18 so that removal of spent liquid can be visibly verified and monitored.

Figure 1:
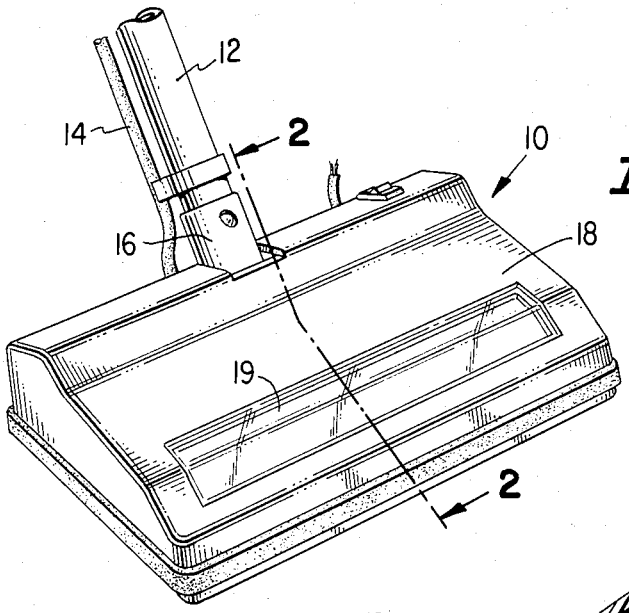
FIG. 1 is a perspective view of a carpet power spray device to which the invention has been applied.
Figure 2:
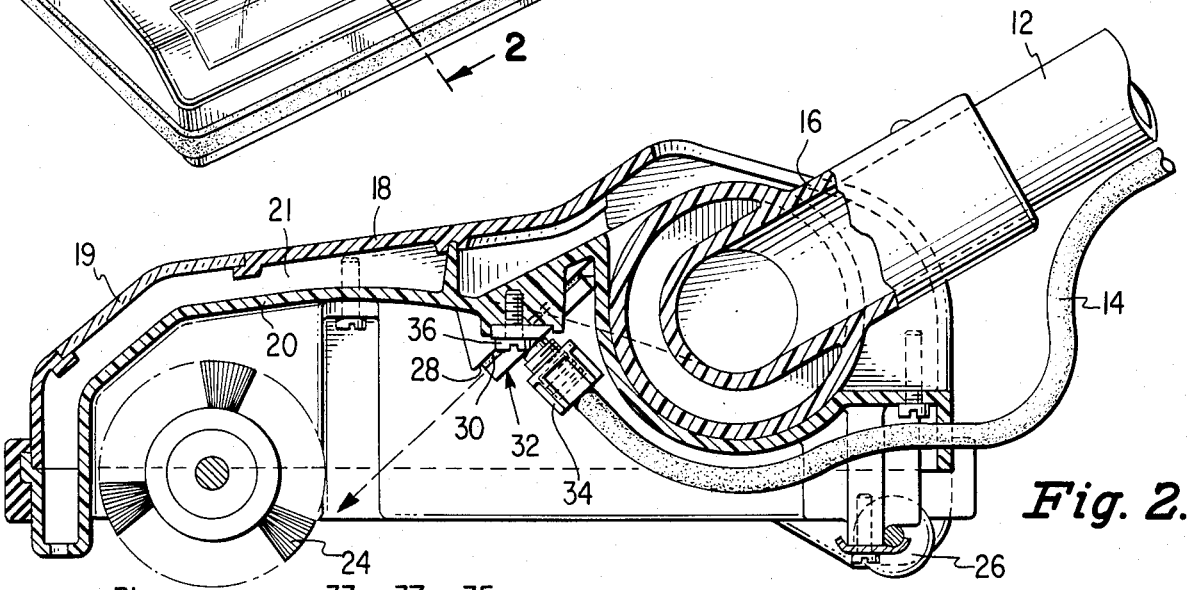
FIG. 2 is a cross-section of the power spray device shown in FIG. 1 taken substantially along the line 2—2 thereof.
Figure 3:
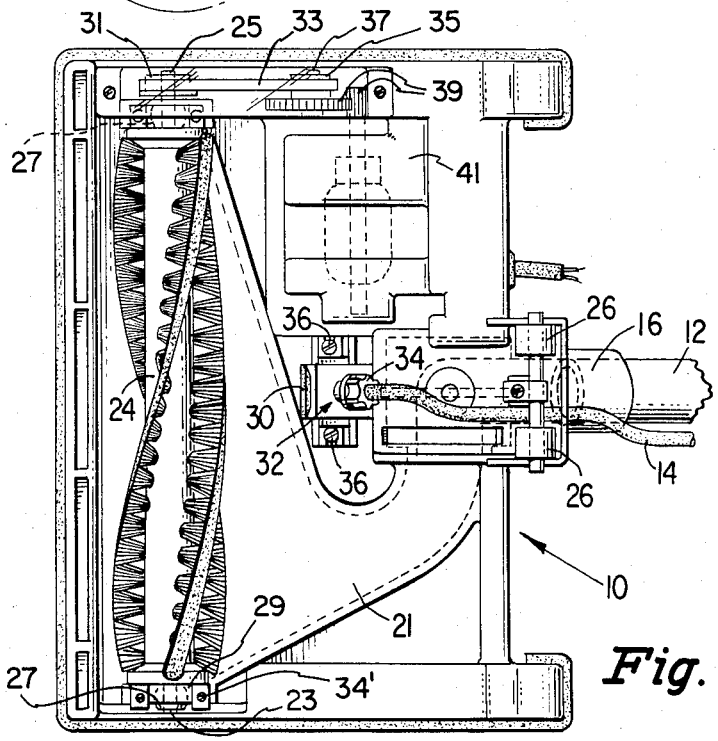
FIG. 3 is a bottom plan view of a portion of the power spray device shown in FIGS. 1 and 2; and, FIG. 4 is a view of the fluidic oscillator shown in FIG. 2 taken substantially along the line 4—4 thereof.

Also supported in the inner housing 20 is floor brush 24 which provides the forward support for the power spray attachment device 10 in contact with the floor. As is apparent by an inspection of FIG. 3, the floor brush 24 is fashioned with spindles 23, 25 extending from the ends thereof through bushings 27 clamped to the inner housing 20 by clamps 29 and retained thereto by screws 34'. Spindle 25 further extends through a pulley 31 connected by a belt 33 to a pulley 35 carried on a shaft 37 connected by speed reduction gears 39 to motor 41 carried by the inner housing 20. A pair of wheels 26, only one of which is shown, are provided at the rear of the power spray attachment device 10 so that the same may be fully supported during the use thereof on the floor brush 24 and the wheels.

Figure 4:
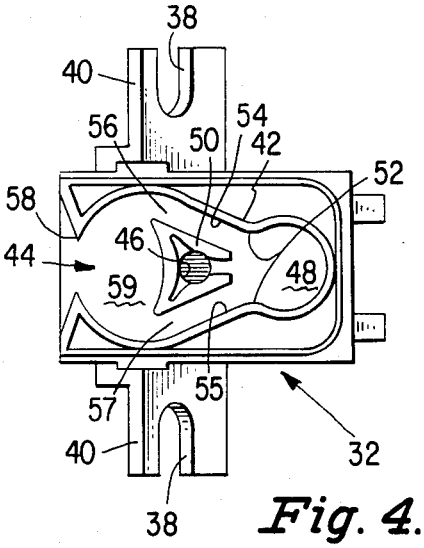

An angled surface 28 is provided on the inner housing centrally located adjacent the swivel 16, the extension to which passes behind the floor brush 24 substantially centrally thereof. A resilient diaphragm 30 is placed on this angled surface 28 and a fluidic oscillator 32 is placed on the diaphragm to be sealed thereby. The fluidic oscillator preferably utilized is fully disclosed and described in the U.S. Pat. No. 4,184,636, issued Jan. 22, 1980 to Bauer, which disclosure is hereby incorporated by reference herein and made a part of this application. The preferred configuration of fluidic oscillator utilized in the power spray attachment device 10 is disclosed in FIG. 4 and provides a 110° spray angle from one extremity of the brush to the other. Referring specifically to FIG. 4, an oscillator/output chamber configuration 42 is implemented by a cavity 44 in a flat surface in the fluidic oscillator 32. The cavity 44 includes an input opening 46 which is directed into a generally circular chamber 48 by means of a generally U-shaped channel 50. U-shaped channel 50 also performs a function as a flow divider. Down stream of the common inlet and outlet opening or neck 52 of circular chamber 48, the side walls 54, 55 of the unit diverge such that side wall 54 along with the flow divider implemented by U-shaped channel 50 forms an outlet passage 56 from the chamber 48, whereas side wall 55 along with the U-shaped channel 50 forms an outlet passage 57. Thereafter, the side walls 54, 55 begin to converge toward outlet opening 58 in output chamber 59. The down stream surface of the U-shaped channel 50 is concave so that a generally rounded output chamber 59 results. Passages 56 and 57 deliver fluid into output chamber 59 in opposite rotational senses. When a liquid is introduced through input opening 46, the U-shaped channel 50 directs a jet of fluid through the opening thereof into the circular chamber 48. Upon impinging against the far wall of the chamber 48, the jet divides into two oppositely directed flows which follow the contour of chamber 48 and egress through outlet passages 56, 57. These two reversing flows form vortexes on opposites sides of the inflowing jet. This condition is highly unstable due to the mutual influences of the flow patterns on on another. Assuming that one vortex predominates, more of the incoming liquid flows in a clockwise or counterclockwise path depending upon which vortex predominates, and flows through a preferred outlet passage 56, 57. For example, if the right hand vortex, as viewed in FIG. 4 were to predominate, a primarily clockwise flow would take place in the circular chamber 48, with the predominate flow in the outlet passage 57. Such a flow would tend to establish a spray pattern to the left as viewed in FIG. 4. However, as the right hand vortex predominates, an instability is created with the left hand vortex, which tends to enlarge the left hand vortex at the expense of the right hand vortex, and which begins to create a counterclockwise flow which fills the outlet passage 56 and generates a spray pattern towards the right as viewed in FIG. 4. Further and more specific detail on the operation of such a fluidic device may be had by reference to the above noted U.S. Patent of Bauer. Liquid provided by the pump (not shown) in the carpet cleaning machine (also not shown) at 11 PSI pressure produces a flow-rate of 0.3 gallons per minute through the fluidic oscllator. Liquid is carried to the fluidic oscillator 32 by the tubing 14 which is threadly connected to the fluidic oscillator by nut 34. By reference to FIG. 3, it may be seen that the fluidic oscillator 32, which is preferably molded of synthetic resin material, is attached to the inner housing 20 by screws 36 extending through slots 38 in wings 40 molded as part of the fluidic oscillator.

The use of the fluidic oscillator as a liquid dispenser in the power spray attachment device 10 has provided a very wide spray angle which allowed a single fluidic oscillator to be mounted in a power spray attachment device. A low profile on the fluidic oscillator, when compared to a conventional nozzle, permits the design of a power spray attachment device with a very low profile for easily extending under furniture. The use of a single fluidic oscillator in place of the plurality of conventional nozzles previously used necessitated the use of larger internal flow dimensions in the fluidic oscillator which decreases the possibility of clogging. Experience with the fluidic oscillator 32 in the power spray attachment device 10 has indicated that the spray angle does not vary with moderate variations in pump performance caused by voltage variations or other causes. These several features make the power spray attachment device 10 extremely compact and less susceptible to extraneous factors interferring with the performance thereof.

I claim:

1. A power spray device for a carpet cleaning machine having a source of vacuum and of liquid, said device comprising: a housing; first means for connecting said housing to said source of vacuum; second means for connecting said housing to said source of liquid; a plenum chamber in said housing communicating with said first means, liquid return orifices in said housing adjacent a carpet to be cleaned and in communication with said plenum chamber; a floor brush rotatably supported in said housing adjacent said liquid return orifices; means for selectively rotating said floor brush; and a fluidic oscillator connected with said second means, means for securing said fluidic oscillator in fixed relationship within said housing, said fluidic oscillator including an outlet port directed toward said carpet adjacent said floor brush for selectively spraying said liquid on said carpet.

2. A power spray device as claimed in claim 1 wherein only a single fluidic oscillator is used, said fluidic oscillator being positioned by said securing means in said housing substantially centrally of said floor brush for selectively cyclically spraying a stream of liquid along the length of said floor brush.

3. A power spray device comprising a housing, a plenum chamber in said housing, liquid return orifices in said housing in communication with said plenum chamber, a floor brush rotatably supported in said housing adjacent said liquid return orifices, means for selectively rotating said floor brush, and means for selectively providing a cyclically sweeping spray pattern adjacent said floor brush and back and forth from one extremity of said brush to the other, said spraying means including a fluidic oscillator secured in fixed relationship within said housing.

* * * * *